United States Patent [19]

Beall

[11] 4,324,338

[45] Apr. 13, 1982

[54] COMPARTMENTED CONTAINER

[76] Inventor: Robert Beall, Rte. 10 Bon Gor Lake, Columbia, Mo. 65201

[21] Appl. No.: 106,893

[22] Filed: Dec. 27, 1979

[51] Int. Cl.[3] ..... B65D 85/00

[52] U.S. Cl. ..... 215/6; 206/217; 220/22

[58] Field of Search ..... 215/6, 236; 206/19, 206/217, 218, 216; 128/222; 426/86, 115, 120; 220/22, 336

[56] References Cited

U.S. PATENT DOCUMENTS

| | | | |
|---|---|---|---|
| 884,450 | 4/1908 | Wright | 220/336 X |
| 978,432 | 12/1910 | Chellis | 215/236 |
| 1,082,710 | 12/1913 | Tangjerd . | |
| 1,473,162 | 11/1923 | Sage | 220/336 |
| 1,798,339 | 3/1931 | Soulis | 206/217 |
| 1,998,373 | 4/1935 | Love | 220/336 |
| 2,611,499 | 9/1952 | Mayer | 215/6 |
| 3,323,755 | 6/1967 | Voitas | 220/336 X |
| 3,514,029 | 5/1970 | Powell | 229/15 |
| 4,033,453 | 7/1977 | Giaimo | 206/217 |
| 4,051,977 | 10/1977 | Steinfeld | 221/96 |
| 4,078,686 | 3/1978 | Karesh | 215/6 |

FOREIGN PATENT DOCUMENTS

| | | | |
|---|---|---|---|
| 1031738 | 5/1978 | Canada | 206/217 |

*Primary Examiner*—Donald F. Norton

*Attorney, Agent, or Firm*—Haverstock, Garrett & Roberts

[57] ABSTRACT

A compartmented container ideally suited for use in conjunction with administering the sacramental elements during a communion service and for taking medication and like substances comprising a body member having first and second ends and a closed side wall portion extending therebetween, an opening extending through the body member, a floor disposed at an intermediate location along the side wall portion and extending across the central opening separating the body member into first and second storage compartments, the first compartment being substantially cup-like in form to hold a liquid therein, the second compartment being located below the first compartment for holding a communion wafer, a pill or tablet, or other non-liquid substance therein, and a closure member directly mounted adjacent to the second end of the body member and movable or removable thereon between a first position closing the second compartment and a second position enabling access thereto.

10 Claims, 5 Drawing Figures

COMPARTMENTED CONTAINER

This invention relates to a simple compartmented container conveniently adaptable for holding and dispensing the sacramental elements of bread and wine in a quick, orderly fashion to an individual or to members of a congregation during a communion service. The device can also be used in the dispensing and taking of medicines and other substances.

Many different kinds of containers are known and have been employed for a wide variety of uses including the holding and dispensing of sacramental elements during a religious communion service. Various procedures are presently being utilized for such communional dispensation, a typical practice being to utilize separate containers such as a chalice or goblet for both the bread and the wine elements. All such devices suffer from certain disadvantages and shortcomings including being costly, cumbersome, inconvenient to handle and operate, and requiring much more time for the dispensing of the elements therefrom thereby considerably extending the overall time involved to perform and conduct a communion service. Devices such as the present device overcome these disadvantages and shortcomings and are particularly advantageous for use in a multitude of situations especially where it is necessary to distribute the bread and wine elements or any other substances to a large group in an expeditous manner.

The known prior art devices teach a variety of container constructions adapted for use in both administering tha sacramental elements of bread and wine and in storing and dispensing liquid and solid substances therefrom; see for examples the constructions shown in Powell U.S. Pat. No. 3,541,029; Tangjerd U.S. Pat. No. 1,082,710; Giaimo U.S. Pat. No. 4,033,453; and Steinfield U.S. Pat. No. 4,051,977. The known constructions for the most part are characterized by complicated and cumbersome container constructions which consist of multiple component parts and require a considerable amount of dexterity in the handling of the substances contained therein, be it bread and wine or any other like substances. Although the container constructions disclosed in the above-identified patents have attempted to improve the capability of effectively and expeditiously storing and dispensing substances therefrom, many disadvantages and shortcomings still exist. One principal problem with the known devices is that they are relatively large, bulky and cumbersome, awkward and difficult to hold, and require considerable time especially when administering the sacramental elements to a large congregation. In addition, the known devices require intricate and cumbersome means for accessing and dispensing the substances contained therein thereby substantially increasing their complexity and requiring added parts as well as additional time and care in dispensing therefrom. Prior art constructions do not provide as simple a container as the present device for holding both the bread and wine elements or other substances, and they do not provide expeditious means for dispensing therefrom. Furthermore, no known device is as simple structurally as the present construction and has a storage compartment integrally located below a liquid holding compartment which storage compartment is accessible through a hinged or other type closure member directly attached to the bottom thereof. For these and other reasons, the known constructions have enjoyed limited usefulness.

The present construction overcomes these and other shortcomings and disadvantages of known container devices including the container constructions disclosed in the named patents, and teaches the construction and operation of a relatively simple device both structurally and operationally which is also relatively inexpensive to make, compact, convenient and especially advantageous for use in religious services where both the bread and wine elements are dispensed to the communicants during the communion service. The present device greatly facilitates and effectively improves the administering of the sacramental elements to a large congregation and considerably decreases the overall time required for distributing the same. In addition, the present device can be easily operated by users having little training or ability and by persons such as the weak, elderly, and the infirm. The present device may also be utilized for dispensing medication and other substances and may likewise be filled or partially filled in an automatic process whereby either one or both end portions thereof may be sealed by a removable gummed sticker or other similar closure means thereby reducing the handling of the contents and making the dispensation of such substances more sanitary.

The present device is comprised of a cup-like compartment which is generally cylindrical in shape and adaptable to hold a liquid therein and preferably has its upper end flared outwardly so as to aid users in drinking. A compartment for holding non-liquid substances is integrally located below the cup portion and is adaptable to receive a communion wafer, a pill, a tablet, or like substance therein. A wall member or door which may be circular in shape is adapted to fit over and close off the bottom end portion of the compartment for the non-liquid substances and is preferably rotatable on the container between its opened and closed positions by means of a pin member or other suitable means so as to allow access thereto to permit the communion bread or any other substance to be dispensed therefrom. The closure member may also include a serrated edge portion to facilitate opening and closing of the door by use of a thumb or forefinger. The present device is preferably constructed of a durable material, preferably transparent, such as a plastic material or impact-resistant glass able to withstand moderate impact and normal usage. In addition, the present device can be made so as to be either disposable or it can be constructed for repeated use, if desired. Although it is anticipated that the present device will be used primarily in association with the administering of the sacramental elements during religious ceremonies, the present device can likewise be conveniently adapted for other uses such as dispensing medication to patients in hospitals or other similar institutions. For all of its various uses and applications, one or both ends of the container can be sealed closed as desired.

It is therefore a principal object of the present invention to provide a simple compartmented container capable of being used to efficiently and expeditiously dispense both a liquid and a non-liquid substance such as to a large group during the communion service or to an individual.

Another object is to provide a compartmented container which is convenient to handle and reduces the overall time required for dispensing the sacramental elements or other substances therefrom.

Another object is to provide a compartmented container which can be made so as to be either disposable or constructed for repeated use.

Another object is to provide a compartmented container which is simple structurally and operationally, compact, and more convenient and advantageous for use especially with large numbers of people.

Another object is to provide a compartmented container which can be easily cleaned and maintained.

Another object is to provide a relatively inexpensive container construction which is light weight, durable and is able to withstand moderate impact and normal usage without breakdown.

Another object is to provide a relatively simple construction which can be economically produced for both commercial and non-commercial use.

Another object is to provide a compartmented container which is easily and conveniently adaptable for dispensing medication including a pill or tablet in association with a liquid.

Another object is to provide a relatively simple and trouble free container which has few moving parts and can be operated by users having little training or ability.

Another object is to provide a compartmented container which may be quickly and easily prepared and refilled for succeeding use, if desired, including filling and refilling in an automatic process.

Another object is to provide a compact compartmented container which can be easily and conveniently carried, transported and stored when not being used.

Another object is to teach the construction and operation of a relatively simple and easy to operate compartmented container for use in religious services where both the bread and wine elements are dispensed.

Another object is to enable solid and liquid substances to be packaged in a single container, which container lends itself to being filled and sealed in a mass production system.

These and other objects and advantages of the present invention will become apparent to those skilled in the art after considering the following detailed specification in conjunction with the accompanying drawings, wherein.

Figure 1:
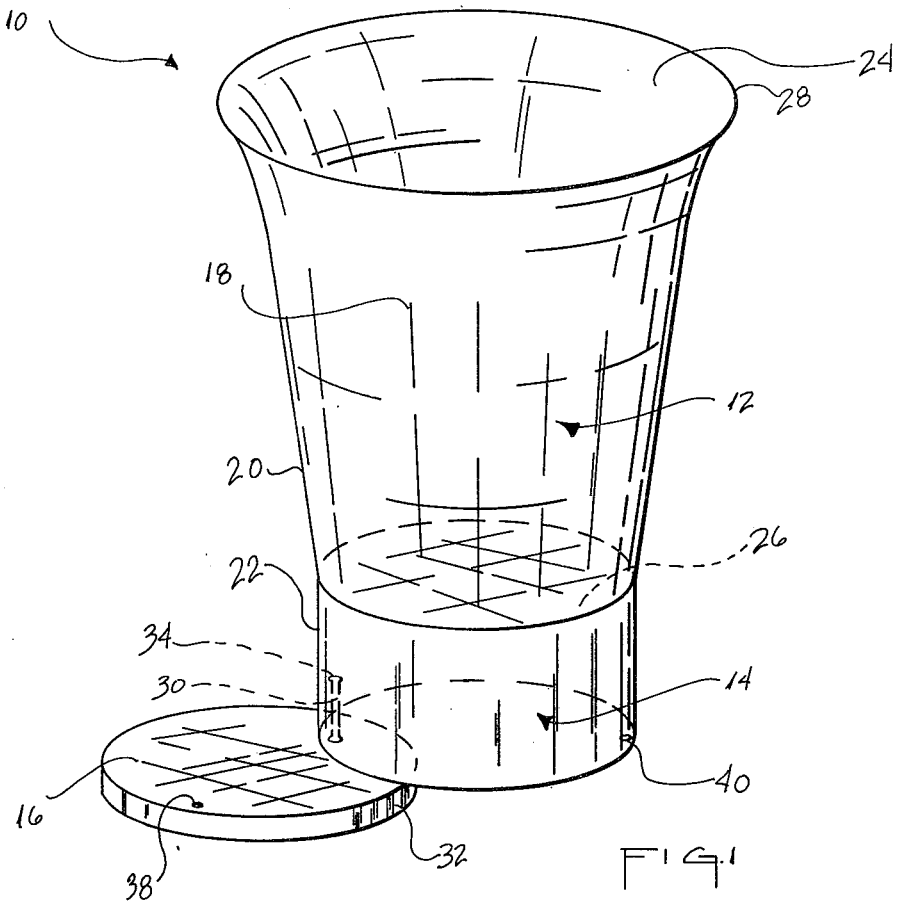
FIG. 1 is an enlarged perspective view of a compartmented container constructed according to the teachings of the present invention, showing the closure member for the lower compartment in its open position.
Figure 2:
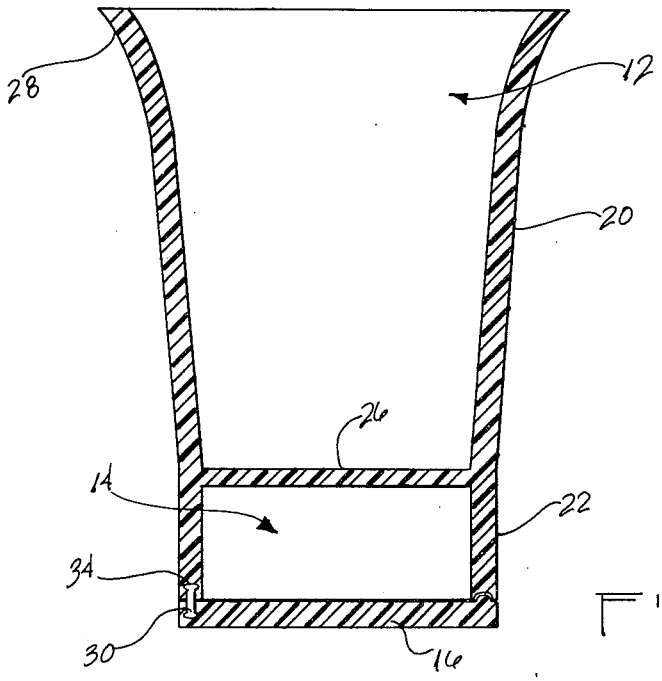
FIG. 2 is a cross-sectional view taken through the center of the compartmented container of FIG. 1 with the lower compartment shown closed.

Referring to the drawings more particularly by reference numbers wherein like numerals refer to like parts, number 10 in FIG. 1 indicates a compartmented container constructed according to the present invention. The container 10 includes a cup-like or liquid holding compartment 12, a storage compartment 14 for non-liquid substances, and a closure member or door 16 mounted to control access to the storage compartment 14. The container 10 includes a closed side wall portion 18 which is shown as being annular and has an opening 24 extending therethrough and a floor member 26 disposed between the ends thereof at a intermediate location. The floor member 26 separates the container into the segregated compartments 12 and 14. The closed side wall member 18 has a portion 20 thereof extending upwardly from the floor member 26 to form the side wall of the liquid holding compartment 12, and another portion 22 that extends in the opposite direction from the floor 26 to form the side wall of the lower storage compartment 14. The position of floor 26 can be varied somewhat depending upon the size and volume desired for each of the respective compartments. In addition, the side wall portion 20 may be tapered somewhat to facilitate handling and holding and the upper end portion of side wall member 20 may be flared outwardly as at 28 for ease of drinking therefrom.

Figure 3:
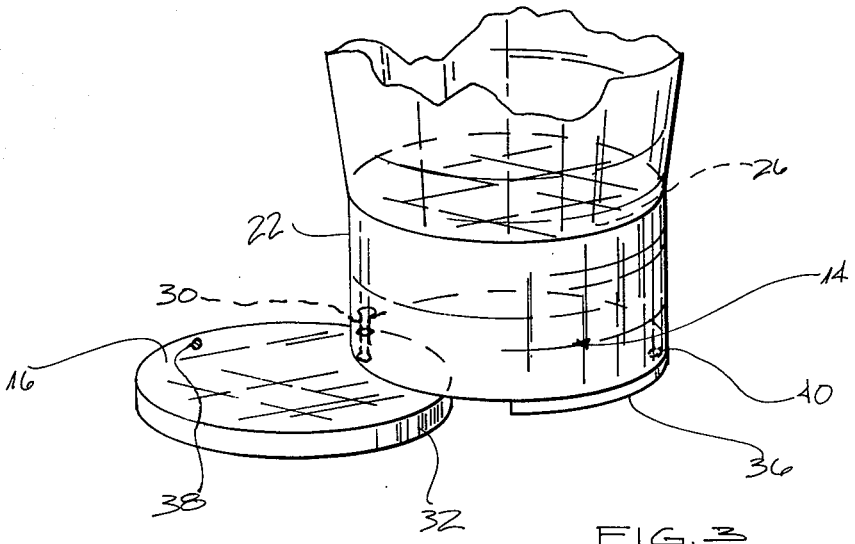
FIG. 3 is a partial perspective view of the lower portion of the subject container showing means for locating and positioning the closure member when closed.

The compartment 14 is integral with the cup-like compartment 12 and is adapted to receive a communion wafer, a pill, a tablet, or some other like substance therein. Access to the compartment 14 is by way of the hinged closure member 16 which is directly attached to the lower end portion of side wall member 22. The closure member 16 is shown as being circular to correspond to the shape of the bottom end of the compartment 14 and is rotatable thereon between its open and closed positions by means of a pin member 30 to prevent or allow access to the lower compartment 14. Pin member 30 is shown having an enlargement 34 at each end which enables it to be forced into holes provided therefor in the wall 22 and in the closure member 16. Although it is recognized that other similar hinge means may likewise be utilized to allow access to the lower compartment, it is preferred that some form of pin or peg means similar to pin member 30 be utilized so that member 16 can be easily moved between its open and closed positions. It is also contemplated that parts of the subject device may be molded to form this pin integrally with one of the members 22 or 16. The pin engagement should also be such that the closure 16 will not move without some force being applied thereagainst. This easy access to the contents of the lower compartment is especially important for the elderly and others who may have difficulty if the operation is too complicated due to infirmities or impairments which affect muscular control and dexterity. In addition, closure member 16 may have a serrated edge portion 32 as shown in FIGS. 1 and 3 to facilitate gripping and moving the member 16. The lower wall portion 22 of the side wall member 18 is preferably not tapered, and the size and shape of the lower compartment 14 should be such as to correspond substantially with and able to receive a conventional communion wafer or like substance. The wall 22 may optionally also have a downwardly extending portion such as downwardly extending edge rim 36 on one side thereof against which member 16 can be moved to locate it when in closed position with respect to the lower compartment 14 as shown in FIG. 3. The member 16 may also have a slight sidewardly extending locating projection 38 positioned thereon to cooperate with a corresponding depression 40 formed in the lower edge of the wall portion 22 to locate and hold the member 16 in its closed position. It should be noted that projection 38 and depression 40 may likewise be interchanged, projection 38 being positioned on wall portion 22 and depression 40 being formed in the upper surface of member 16.

Figure 4:
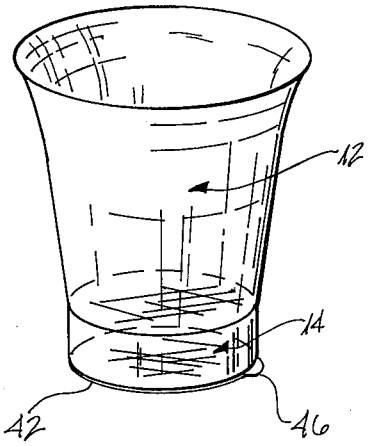
FIG. 4 shows another embodiment of the subject container with a different form of closure member for the lower compartment.
Figure 5:
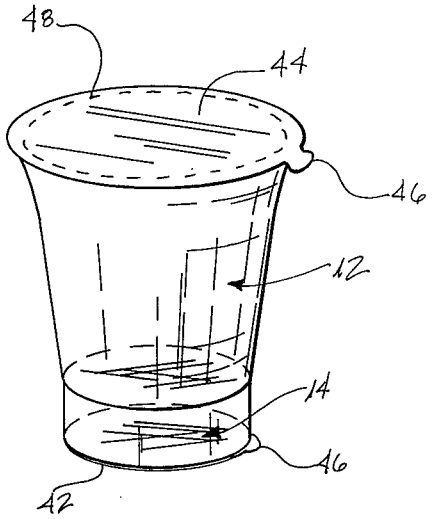
FIG. 5 shows still another embodiment with closure means associated with each of the container compartments.

Referring to FIGS. 4 and 5, it is also anticipated that a removable or rupturable closure member such as gummed stickers 42 and 44, or other similar closures can be affixed to the top and bottom end portions of the device to close one or both of the compartments 12 and 14. Such a closure member may include a tab 46 extending from the side of the device to facilitate gripping it and peeling the member off from the container. The closures 42 and 44 may also have perforations such as perforations 48 to facilitate the puncturing thereof. In addition, use of a removable member enables one or both compartments of the present device to be easily and economically filled and/or refilled both with a liquid and a non-liquid substance in an automatic process.

In as much as the present device 10 is compact and does not require intricate and cumbersome means for storing, accessing and dispensing elements therefrom, it is ideally suited for use in conjunction with the administering of the sacramental elements during a communion service. Furthermore, because of its simplicity both structurally and operationally, the present device greatly facilitates such administration and considerably reduces the overall time required for dispensing the contents even to a relatively large congregation. To receive the sacramental elements or otherwise dispense substances from the present container, a communicant simply rotates closure member 16 to its open position thereby dispensing the communion wafer or bread element from the lower compartment and thereafter drinks the wine contained in the liquid holding compartment 12. This relatively simple method of dispensing both the bread and wine elements from a single container is important to the present invention because it not only improves the overall efficiency of dispensing the sacramental elements but likewise enables all communicants regardless of age, health, and manual dexterity to quickly and easily participate in and partake of the communion service. Although it is anticipated that the present device will be used primarily in association with the administration and distribution of the sacramental elements during a religious ceremony, it should be noted that the present device has many other possible applications and uses including being easily and conveniently adaptable for storing and dispensing other items such as medication especially when a pill or tablet is to be taken with water or some other liquid. For example, a quantity of medicaments in pill or tablet form can be conveniently stored in the lower compartment 14 and may be dispensed therefrom and consumed along with a liquid contained within the liquid holding compartment. Typical of such uses are uses by anyone who takes medicine with a liquid such as the chronically ill who take medication to control an illness. Additionally, the present device is particularly adaptable for dispensing medication in hospitals or other similar institutions because a predetermined dosage level of a particular type of prescribed medication may be stored in the lower compartment and may be distributed to the patient with the upper compartment containing a fluid which may be water or some liquid that itself contains a medication and therefore should be controlled by the person preparing the subject device.

Although it is recognized that various materials of construction are available, it is preferred that the present device 10 be constructed of some durable impervious material, preferably transparent, such as certain plastic materials which are able to withstand some abuse during normal usage and are both readily available and inexpensive. A relatively hard plastic or impact-resistant glass could likewise be utilized. The present device 10 can be made so as to be either disposable or it can be constructed for repeated use, if desired and depending on which is preferred, this may control what substance is used in the construction of the device. If the device 10 is constructed for repeated use, its construction lends itself to being easily cleaned and prepared for succeeding use and it can be conveniently carried, transported or stored in a relatively small space. The ease of handling, storing and transporting further increases the flexibility, versatility and usefulness of the subject device. Where it is anticipated that the present device will only be used once or, at most, a few times and then discarded, it can be conveniently constructed from a relatively inexpensive material so as to be disposable after usage. In either case, it is to be noted that the present device is relatively easy to make using known molding and extrusion techniques and known plastics or other substances.

Similarly, color and/or artistic designs may be easily incorporated in or on translucent plastic materials for enhancing the beauty and aesthetic qualities of the device. In addition, it is also recognized that the side wall portion of the present device may be conveniently fashioned into a variety of sizes and configurations, for example, a circular, elliptical, oval, hexagonal, or other configuration, without departing from the teachings and practice of the present construction. The simplicity, durability, flexibility and versatility of the present device greatly increases its usefulness and effectiveness for expeditiously administering the sacramental elements during a communion service as well as for a wide variety of other uses and applications.

Thus there has been shown and described a novel compartmented container conveniently adapted for use in administering the sacramental elements of bread and wine during a communion service and for taking medication and like substances, which container fulfills all of the objects and advantages sought therefor. Many changes, modifications, variations and other uses and applications of the present compartmented container will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A reusable compartmented container adaptable for holding a liquid and a non-liquid substance therein comprising a body member having a first substantially cup-like portion for holding the liquid substance therein and a second portion defining a second compartment for receiving and holding the non-liquid substance therein, said body member having first and second ends and a closed side wall portion extending therebetween, a wall member disposed at an intermediate location along the closed side wall portion separating the cup-like portion from said second compartment, a movable reclosable closure member attached to the closed side wall portion of said body member adjacent to the second end thereof, said closure member, said closed side wall portion and said wall member defining the second compartment, said closure member including means associated therewith for hingedly attaching said closure member to the second end of the closed side wall portion thereby enabling said closure member to be rotatable relative to the second end portion of said body member between a position closing the second compartment and a position providing access thereto, said first end of said body member being flared outwardly to facilitate drinking therefrom.

2. The compartmented container defined in claim 1 wherein said closure member has a serrated edge portion associated therewith to facilitate the opening and closing of said member.

3. A reusable compartmented container for holding a liquid and a non-liquid substance therein comprising a tubular body member having first and second end portions and a side wall portion extending therebetween defining a central opening therethrough, a floor member extending transversely across said central opening at an intermediate location along said side wall portion to separate the central opening into compartments on opposite sides thereof, said floor member and said side wall portion defining a first substantially cup-shaped compartment extending to one end of the body member for holding a liquid therein and a second compartment extending to the opposite end of said body member for receiving and holding a non-liquid substance therein, a closure member and means pivotally attaching the closure member to the second end of said body member in position extending across said second end to close said second compartment, said closure member being movable on said second end of the body member between open and closed positions, said second end of the side wall portion and said closure member having cooperatively engageable means associated therewith to limit relative movement therebetween, said closure member retaining a non-liquid substance in the second compartment when in its closed position, said first end of said body member being flared outwardly to facilitate drinking therefrom.

4. The compartmented container defined in claim 3 wherein said second end of said side wall portion includes a downwardly extending peripheral edge portion on one side thereof which is engageable by the closure member when in its closed position.

5. A reusable container dispensing device having a cup portion for holding a liquid substance and a second compartment portion for holding a non-liquid substance comprising a container body member having first and second compartments formed therein, said container body including a tube-like member having first and second ends and a side wall portion extending therebetween with a central opening extending through said container body, a floor member disposed at an intermediate location between said first and second ends of said side wall portion across said central opening separating said container body into said first and second compartments, said first compartment being adaptable to receive and hold a liquid therein, said second compartment being adaptable to receive and hold a non-liquid substance therein, a closure member movably mounted on said second end of said container body and extendable thereacross in one position thereof to form a bottom closure wall portion for said second compartment, said closure member having pivot means associated therewith connecting it to the tube-like member adjacent to the second end thereof enabling the closure member to be rotatably moved relative to the second end of said container body between open and closed positions to control access to said second compartment, and means on the body member for locating and positioning said closure member in the closed position thereof including cooperatively engageable means on the closure member and on the container body to hold said closure member in its closed position, said first end of said tube-like member being flared outwardly to facilitate drinking therefrom.

6. The container dispensing device defined in claim 5 wherein said means for locating and positioning said closure member in closed position includes a downwardly extending peripheral flange located on one side portion of said second end of said container body, said peripheral flange being engageable by the closure member in the closed position thereof.

7. A container dispensing device defined in claim 5 wherein said means for holding said closure member in its closed position includes a depression formed on one of said members and a projection formed on the other member, said projection being in a position to engage said depression when the closure member is in its closed position.

8. A reusable compartmented container adaptable for holding a liquid and a non-liquid substance therein comprising a body member having a first substantially cup-like portion for holding the liquid substance therein and a second portion defining a second compartment for receiving and holding the non-liquid substance therein, said body member having first and second ends and a closed side wall portion extending therebetween, a wall member disposed at an intermediate location along the closed side wall portion separating the cup-like portion from said second compartment, a movable reclosable closure member attached to the closed side wall portion of said body member adjacent to the second end thereof, said closure member, said closed side wall portion and said wall member defining the second compartment, said closure member including means associated therewith for hingedly attaching said closure member to the second end of the closed side wall portion thereby enabling said closure member to be rotatable relative to the second end portion of said body member between a position closing the second compartment and a position providing access thereto, the portion of said closed side wall portion defining said cup-like compartment being tapered from end-to-end.

9. A reusable compartmented container for holding a liquid and a non-liquid substance therein comprising a tubular body member having first and second end portions and a side wall portion extending therebetween defining a central opening therethrough, a floor member extending transversely across said central opening at an intermediate location along said side wall portion to separate the central opening into compartments on opposite sides thereof, said floor member and said side wall portion defining a first substantially cup-shaped compartment extending to one end of the body member for holding a liquid therein and a second compartment extending to the opposite end of said body member for receiving and holding a non-liquid substance therein, a closure member and means pivotally attaching the closure member to the second end of said body member in position extending across said second end to close said second compartment, said closure member being movable on said second end of the body member between open and closed positions, said second end of the side wall portion and said closure member having cooperatively engageable means associated therewith to limit relative movement therebetween, said closure member retaining a non-liquid substance in the second compartment when in its closed position, the portion of said side wall portion defining said cup-shaped compartment being tapered from end-to-end.

10. A reusable container dispensing device having a cup portion for holding a liquid substance and a second compartment portion for holding a non-liquid substance comprising a container body member having first and second compartments formed therein, said container body including a tube-like member having first and second ends and a side wall portion extending therebetween with a central opening extending through said container body, a floor member disposed at an intermediate location between said first and second ends of said side wall portion across said central opening separating said container body into said first and second compartments, said first compartment being adaptable to receive and hold a liquid therein, said second compartment being adaptable to receive and hold a non-liquid substance therein, a closure member movably mounted on said second end of said container body and extendable thereacross in one position thereof to form a bottom closure wall portion for said second compartment, said closure member having pivot means associated therewith connecting it to the tube-like member adjacent to the second end thereof enabling the closure member to be rotatably moved relative to the second end of said container body between open and closed positions to control access to said second compartment, and means on the body member for locating and positioning said closure member in the closed position thereof including cooperatively engageable means on the closure member and on the container body, the portion of said side wall portion defining said first compartment being tapered from end-to-end.

* * * * *